US005094193A

United States Patent [19]

Yoshikawa

[11] Patent Number: 5,094,193

[45] Date of Patent: Mar. 10, 1992

[54] CYLINDER HEAD COOLING ARRANGEMENT

[75] Inventor: Masaaki Yoshikawa, Iwata, Japan

[73] Assignee: Yamaha Hatsudoki Kabushika Kaishas, Iwata, Japan

[21] Appl. No.: 570,315

[22] Filed: Aug. 21, 1990

[30] Foreign Application Priority Data

Aug. 23, 1989 [JP] Japan ..... 1-218123

[51] Int. Cl.[5] ..... F01P 3/02

[52] U.S. Cl. ..... 123/41.82 R; 123/41.74

[58] Field of Search ..... 123/41.74, 41.82 R, 123/315, 432

[56] References Cited

U.S. PATENT DOCUMENTS

| | | | |
|---|---|---|---|
| 2,710,602 | 6/1955 | Maybach | 123/41.82 R |
| 4,658,763 | 4/1987 | Gobien et al. | 123/41.82 R |
| 4,877,004 | 10/1989 | Mishizawa | 123/432 |
| 4,889,079 | 12/1989 | Takeda et al. | 123/41.82 R |

*Primary Examiner*—Noah P. Kamen

*Attorney, Agent, or Firm*—Ernest A. Beutler

[57] ABSTRACT

A cooling jacket arrangement for a cylinder head having an arrangement for redirecting the flow of coolant so that it will flow toward the central portion of the cylinder head and in the area where there is a small area between the intake and exhaust ports so as to insure adequate cooling.

17 Claims, 6 Drawing Sheets

CYLINDER HEAD COOLING ARRANGEMENT

BACKGROUND OF THE INVENTION

This invention relates to a cylinder head cooling arrangement and more particularly to a cooling arrangement for the cylinder head of a multi-valve internal combustion engine.

As is well known, overhead valve internal combustion engines have their intake and exhaust ports extending through the cylinder head and terminating in the combustion chamber formed therein. It is the conventional practice to provide a liquid cooling jacket for the cylinder head which cools at least a portion of the area around the ports and also which is intended to cool the combustion chamber. However, it is also known to be desirable to provide as large a valve port area as possible. This may be done either through the use of single, relatively large, intake and exhaust valves or multiple valving arrangement. However, with engines employing large exhaust port areas, there is an area of the cylinder head which defines the combustion chamber wherein there is a relatively small surface area formed between the ports. This area generally lies centrally of the cylinder head.

The cooling jacket for the cylinder head normally receives cooling water that flows in from one side of the cylinder head and exits from the other side. However, because of the port configuration, the water introduction to the area of the cylinder head bounding the combustion chamber is generally at the sides of the combustion chamber. As a result, the highly heated area between the intake and exhaust ports and at the center of the combustion chamber may not be adequately cooled with prior art construction.

It is therefore, a principal object of this invention to provide an improved cooling arrangement for the cylinder head of an internal combustion engine.

It is a further object of this invention to provide an improved cylinder head cooling arrangement for an internal combustion engine wherein the central portion of the combustion chamber between intake and exhaust ports is adequately cooled.

SUMMARY OF THE INVENTION

This invention is adapted to be embodied in a cooling arrangement for the cylinder head of an internal combustion engine. The cylinder head has a lower surface forming a closure for the cylinder bore and defining at least in part a combustion chamber for the engine. An intake passage extends through one side of the cylinder head and terminates in at least one intake port formed in the lower surface on one side thereof. An exhaust passage extends from an exhaust port formed in the lower surface on the other side thereof through the other side of the cylinder head. The cylinder head lower surface is formed with a central portion that extends between the intake and exhaust ports. A cooling jacket is formed in the cylinder head extending at least in part around the intake and exhaust passages and the lower surface. The flow of liquid coolant extends from at least side of one of the passages to the corresponding side of the other of the passages. Flow directing means extend into the cooling jacket for redirecting at least a portion of the coolant flow toward the central portion.

DETAILED DESCRIPTION OF THE PREFERRED EMBODIMENTS OF THE INVENTION

Figure 1:
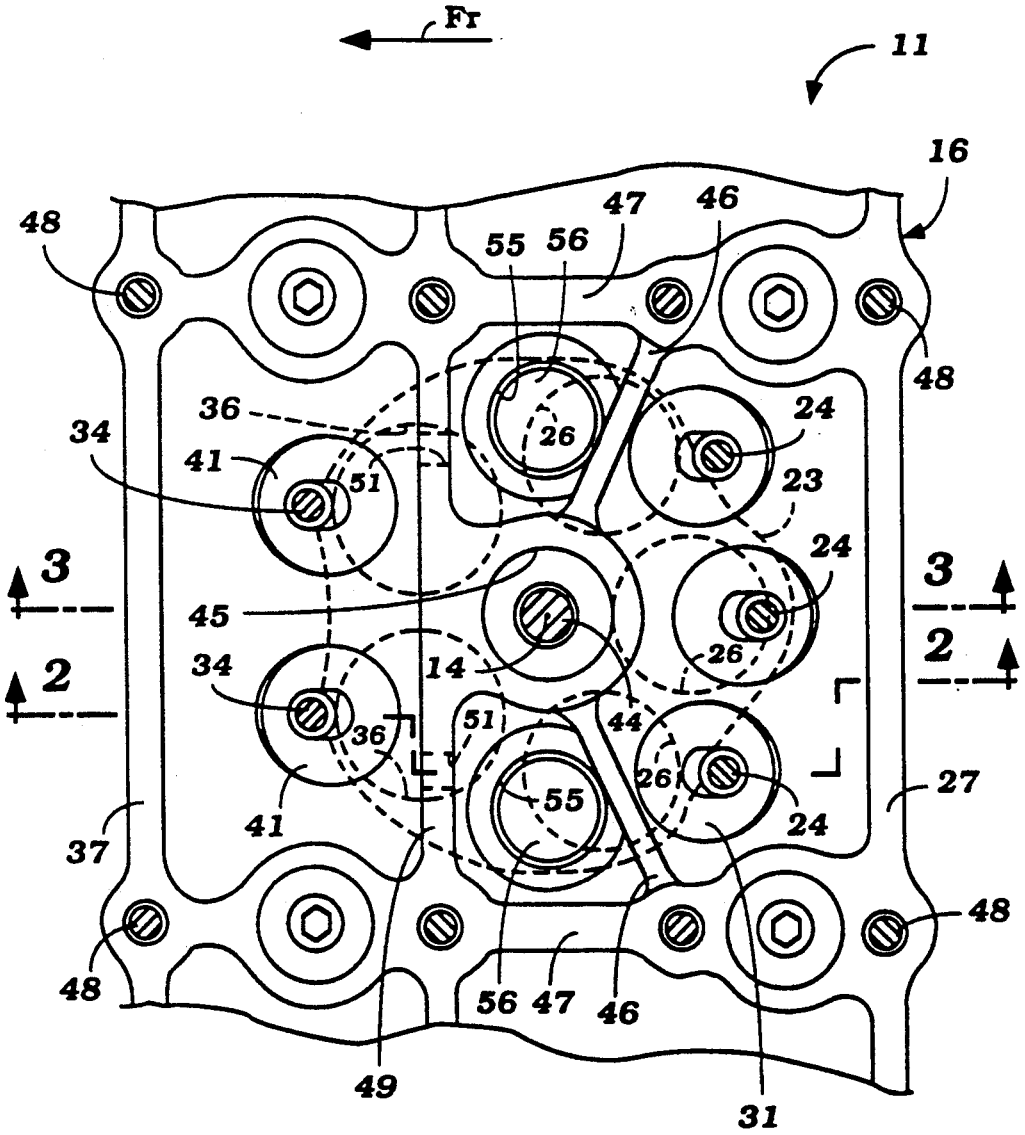
FIG. 1 is a top plan view of a cylinder head of an internal combustion engine constructed in accordance with an embodiment of the invention, with portions of the cylinder head assembly removed to more clearly show the construction of the cylinder head per se.
Figure 2:
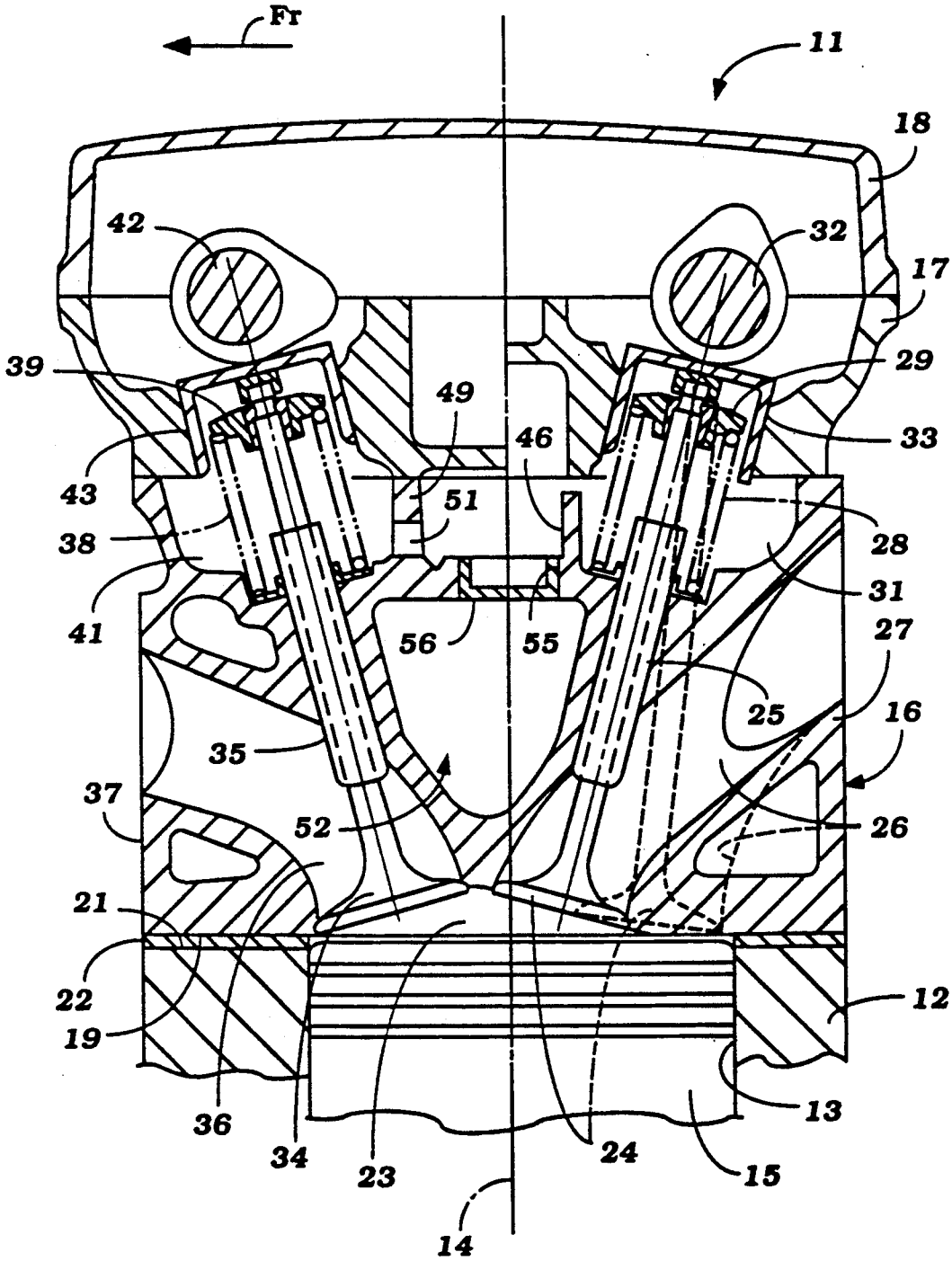
FIG. 2 is a cross-sectional view taken along the line 2—2 of FIG. 1.
Figure 3:
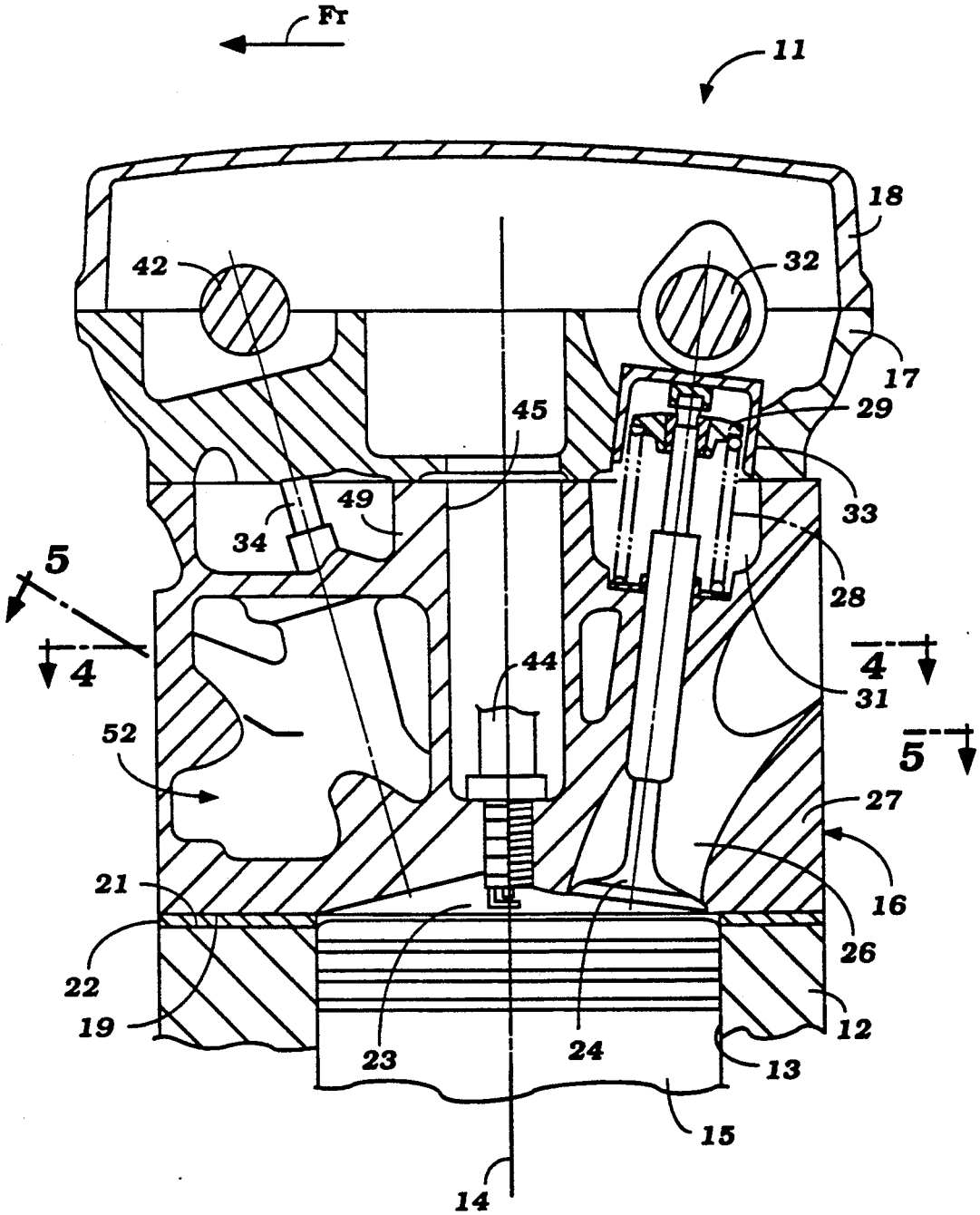
FIG. 3 is a cross-sectional view taken along the line 3—3 of FIG. 1.

Referring first to the embodiment of FIGS. 1-5 and initially to FIGS. 2 and 3, an internal combustion engine constructed in accordance with an embodiment of the invention is shown partially and is identified generally by the reference numeral 11. Inasmuch as the invention relates to the cylinder head and cooling jacket arrangement therefor, only this portion of the engine has been depicted. Also, since the invention is adapted to be utilized in conjunction with engines having any numbers of cylinders and any cylinder configuration, only the construction associated with a single cylinder has been illustrated. It is believed obvious to those skilled in the art how the invention can be employed in conjunction with engines having other numbers of cylinders and other cylinder configurations.

The engine 11 includes a cylinder block 12 that is formed with a cylinder bore 13 which, in the illustrated embodiment, is a right circular cylinder generated around the axis 14 as shown in the dot dash line in FIGS. 2 and 3.

A piston 15 is slidably supported within the cylinder bore 13 and is connected by means of a connecting rod (not shown) in a known manner to drive a crankshaft, which is also not shown for the aforenoted reasons.

A cylinder head assembly comprised of a cylinder head 16, cam carrier 17 and cam cover 18 are affixed to the cylinder block 12 in any appropriate manner. The cylinder head 16 has a lower surface 19 which faces a corresponding surface 21 of the cylinder block 12. A sealing gasket 22 is provided between the surfaces 19 and 21 around the cylinder bore 13. The portion of the cylinder head lower surface 19 overlying the cylinder bore 13 is provided with a recessed area 23 which forms the combustion chamber of the engine when the piston 15 is at top dead center.

An array of three intake valves, each identified by the reference numeral 24 is positioned in the cylinder head assembly and is specifically supported by respective pressed in valve guides 25 in the cylinder head 16. The intake valves 24 are arranged generally in a configuration as set forth in U.S. Pat. No. 4,660,529, entitled FOUR-CYCLE ENGINE, issued Apr. 28, 1987 in the name of Masaaki Yoshikawa and assigned to the assignee hereof. The disclosure of that patent is incorporated herein by reference insofar as the placement of the intake valves 24 is concerned.

The intake valves 24 control the flow through intake passages 26 that extend through an intake side 27 of the cylinder head 16. In the illustrated embodiment, the intake passages 26 are siamese. That is, the intake passages 26 extend from a common inlet opening formed in the intake side 27 of the cylinder head 16 to the individual valve seats or ports with which the heads of the valves 24 cooperate. Although such a siamese arrangement is described, it is to be understood that the invention can be utilized in conjunction with engines having other types of valve porting or, in fact, engines having different numbers of intake valves than the three intake valves 24 described herein. However, the invention has particular utility in conjunction with multiple valve engines due to the small surface area that is provided for by the combustion chamber, as will be hereinafter described.

As disclosed in aforenoted U.S. Pat. No. 4,660,529 the heads of two of the intake valves 24 extend partially over a plane containing the cylinder bore axis 14.

Valve springs 28 encircle the stems of each of the intake valves 24 and act against keeper retainer assemblies 29 for urging the intake valves 24 to their closed positions. The springs 28 are received within recesses 31 formed in the upper surface of the cylinder head 16 as best seen in FIG. 1.

The intake valves 24 are open by means of an intake camshaft assembly 32 that is journaled in an appropriate manner between the cam carrier 17 and the cam cover 18 and which operate on thimble tappets 33 that are slidably supported in bores in the cam carrier 17.

Supported for reciprocation within the cylinder head 16 on the opposite side of the aforenoted plane containing the axis of the cylinder bore 14 are a pair of a exhaust valves 34. The exhaust valves 34 are supported by guides 35 pressed into the cylinder head 16 and which control the flow through respective exhaust ports 36 that extend from the combustion chamber recess 23 to an exhaust side 37 of the cylinder head 16. In the illustrated embodiment, the exhaust passages 36 are partially siamese. As with the intake ports 26, however, it is to be understood that any type of port configuration can be employed and the number of exhaust valves per cylinder can be varied. The exhaust valves 34 are, however, oriented in accordance with the illustrated embodiment of the invention as described in aforenoted U.S. Pat. No. 4,660,529.

The exhaust valves 34 are urged toward their closed positions by means of coil compression springs 38 that act against keeper retainer assemblies 39 affixed to the upper ends of the stems of the exhaust valves 34. The lower ends of the springs 38 are received in recesses 41 formed in the upper cylinder head surface as may be best seen in FIG. 1. An exhaust camshaft 42 is journaled between the cam carrier 17 and the cam cover 18 in a known manner and acts against thimble tappets 43 that are slidably supported in the cam carrier 17 for operating the exhaust valves 34 in a well known manner.

A spark plug 44 is positioned in a spark plug well 45 formed on the cylinder bore axis 14 and is fired in a suitable manner so as to ignite combustion in the combustion chamber recess 23 in a well known manner. Although the invention has particular utility in conjunction with a centrally positioned single spark plug, it is to be understood that the invention may be employed in conjunction with engines having twin spark plugs one positioned at either side of the combustion chamber.

As may be best seen in FIG. 1, the upper surface of the cylinder head 11, which defines a generally open cavity, is reinforced by a pair of angularly disposed ribs 46 that extend from the outer surface of the spark plug well 45 to a pair of transversely extending walls 47 that bound the outer periphery of the cylinder bore 13. Threaded fasteners 48 are received in the walls 47 and serve to affix the cylinder head 16 to the cylinder block 12. A further wall 49 extends on one side of the plane containing the cylinder bore axis 14 toward the exhaust valves 34 and between the walls 47 for further reinforcing of the cylinder head assembly. This wall 49 also intersects the wall defining the spark plug well 45. Drain holes 51 extend through the wall 49 so as to permit lubricant to flow therethrough.

A liquid cooling jacket, indicated generally by the reference numeral 52 is formed internally of the cylinder head and extends partially around the intake passages 26 and the exhaust passages 36 for cooling purposes. It should be noted that the interior of the cylinder head is provided with walls 53 which generally lie under the walls 47 of the exterior surface and which pass the fastening bolts. These internal walls 53 offer further reinforcing for the cylinder head assembly. Generally cooling water is delivered to the cylinder head cooling jacket 52 from the cylinder block and normally through passages formed on opposite sides of the intake passages 26 so as to flow in the direction of the arrows 54. This coolant then flows across the cylinder head after having cooled the intake passages 26 toward the exhaust passages 36 so as to cool them. The coolant water then exits the cylinder head in an appropriate manner, for example through water returns formed at one side of the cylinder block.

A plurality of clean out openings 55 are formed in the cylinder head upper surface and are closed by closure plugs 56. These openings 55 permit sand from the casting process to be removed and other cleaning to be accomplished before the plugs 56 are inserted in place.

Figure 4:
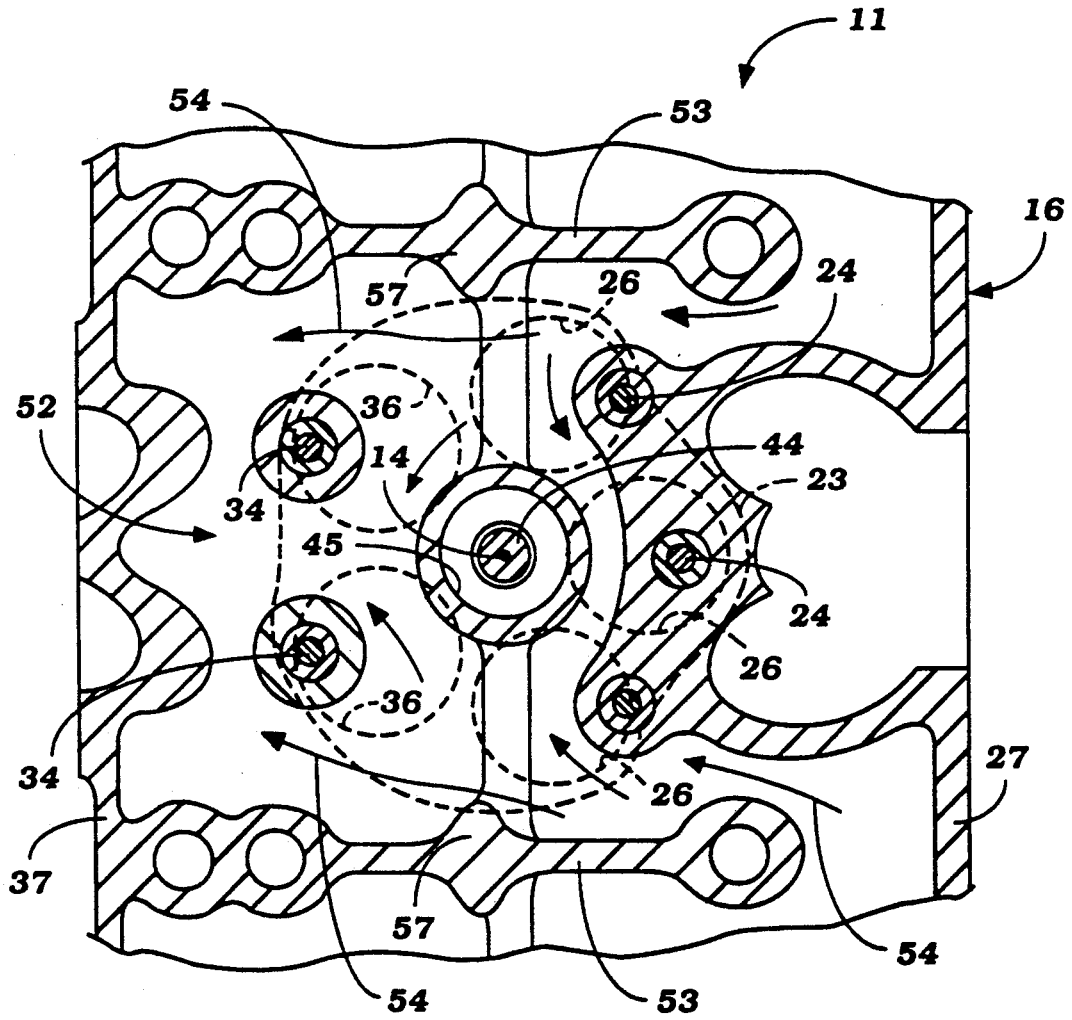
FIG. 4 is a cross-sectional view taken along the line 4—4 of FIG. 3.
Figure 5:
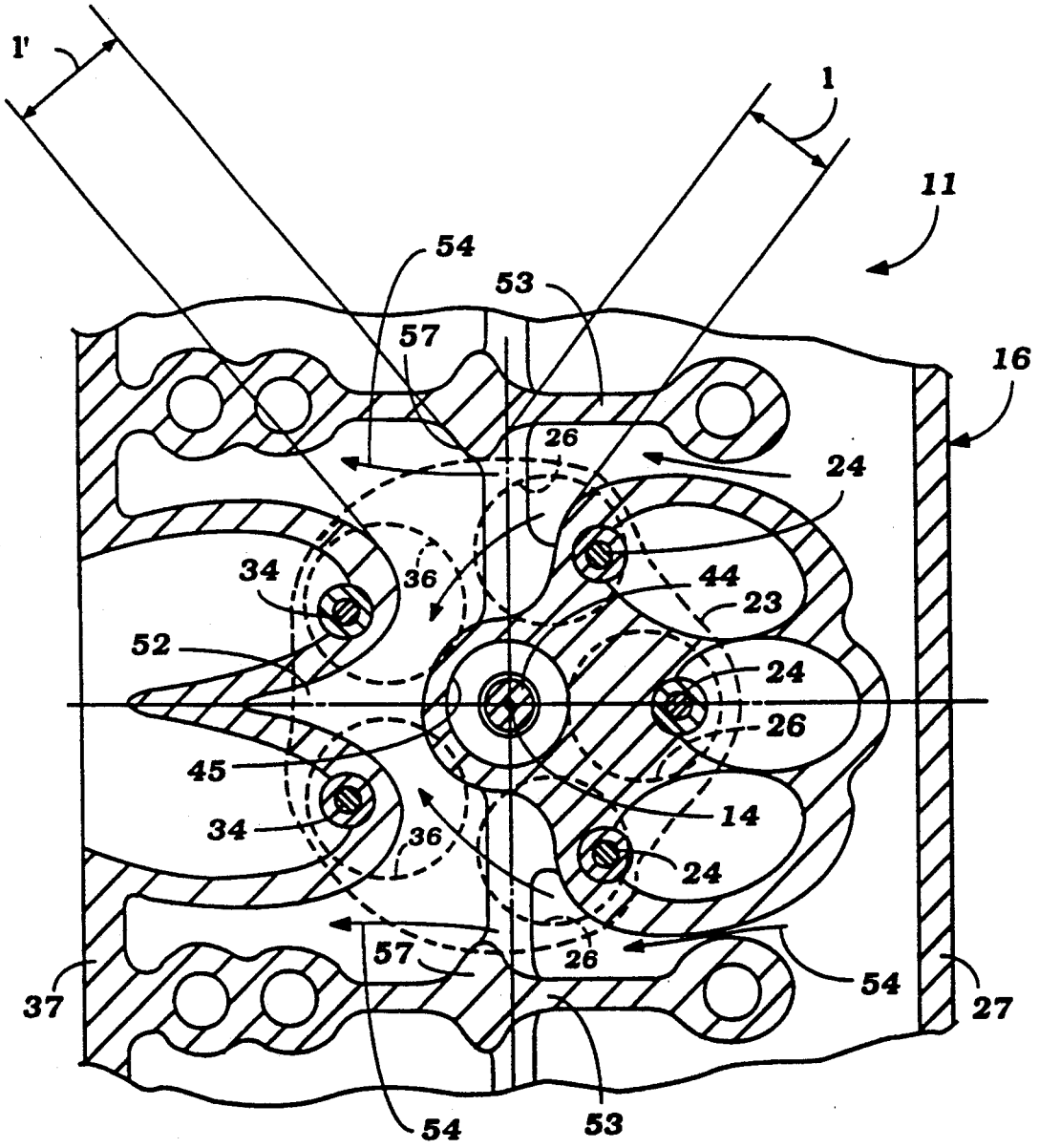
FIG. 5 is a cross-sectional view taken along the line 5—5 of FIG. 3.

From FIGS. 4 and 5 it should be readily apparent that the cooling jacket 52 and flow pattern therethrough tends to cause the cooling water to flow away from the center are of the cylinder head and specifically the central area where the spark plug 44 is positioned in the illustrated embodiment. Of course, this same condition would be true with the side mounted spark plug arrangements previously described. In accordance with the invention, there are provided flow directing projections 57 which in this embodiment are formed integrally with the walls 53 and which are disposed on the exhaust side of the plane containing the cylinder bore axis 14. These projections 57 extend into and redirect the flow of coolant across the cylinder head 16 so that the flow will be directed not only toward the central area of the combustion chamber, which is highly heated due to the proximity of the intake and exhaust ports, but which also has a relatively small surface area. As a result of this redirection of the flow, it will be insured that even the most highly heated portions of the cylinder head will be adequately cooled and that there will not be any hot spots in the cylinder head that could cause thermal distortion or other unsatisfactory results.

It should also be noted that the distance 1 between the projection 57 and the surface which surrounds the intake ports 26 is substantially the same as the corresponding distance 1, between the projections 57 and the corresponding surfaces of the cylinder head that define the exhaust passages 36. As a result, the flow will be substantially uniform and unobstructed across the cylinder head.

Figure 6:
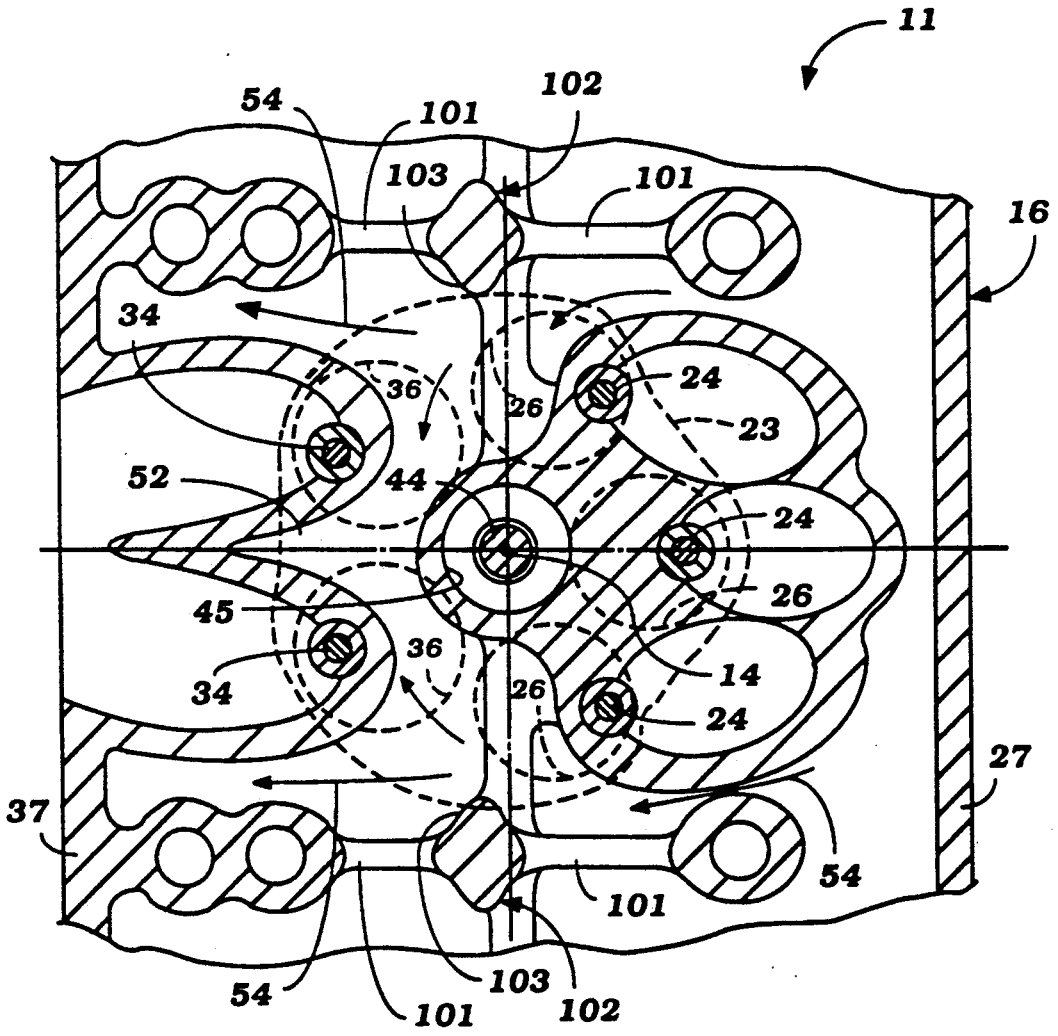
FIG. 6 is a cross-sectional view, in part similar to FIG. 5, and shows another embodiment of the invention.

FIG. 6 shows another embodiment of the invention which is substantially the same as the embodiment of FIGS. 1-5. In this embodiment, however, the internal walls 53 are in fact deleted and there are provided recesses 101 that extend in the cylinder head beneath the upper wall 47 and which surround the area where the head fastening bolts are received. However, there are provided wall like members 102 between the recesses 101 that have projections 103 that serve to redirect the flow of coolant toward the central are as aforedescribed. In all other regards this embodiment is the same as that previously described and, for that reason, further description of this embodiment is believed to be unnecessary.

In view of the foregoing, it should be readily apparent that the described constructions provide a very affective cooling system for a cylinder head which permits large intake and exhaust port areas while still maintaining uniform cooling across the cylinder head and without any hot spots in the area where water might not flow with normal cooling arrangements heretofore used. It is, of course, to be understood that the embodiments of the invention both illustrated and described are only preferred embodiments of the invention and that various changes and modifications may be made without departing from the spirit and scope of the invention, as defined by the appended claims.

I claim:

1. A cooling arrangement for the cylinder head of an internal combustion engine, said cylinder head having ends and opposing sides, said cylinder head further having a lower surface forming a closure of a cylinder bore and defining at least in part a combustion chamber for said engine, an intake passage extending through one side of said cylinder head and terminating at least one intake port formed in said lower surface on one side thereof, an exhaust passage extending from at least one exhaust port formed in said lower surface on the other side thereof through the other side of said cylinder head, said cylinder head lower surface being formed with a central portion extending between said intake and exhaust ports, a cooling jacket formed in said cylinder head extending at least in part around said intake and exhaust passages and said lower surface, a pair of spaced apart means for introducing liquid coolant to said cylinder head at least at one side of said cylinder head and each spaced toward a respective one end of said cylinder head from one of said passages for directing liquid coolant toward the respective corresponding side of the other of said passages for discharge from an outlet to establish a cross flow of coolant across said engine head, and a pair of flow directing means each extending into said cooling jacket for redirecting at least a portion of the coolant flow away from the respective end of said cylinder head toward each other and toward said central portion.

2. A cooling arrangement as set forth in claim 1 wherein there are pair of walls formed in the cooling jacket on the opposite ends of the central surface with the flow directing means being formed by projections of said walls.

3. A cooling arrangement as set forth in claim 2 wherein the projections are offset from the center of the cylinder toward the side from which the flow exits.

4. A cooling arrangement as set forth in claim 3 wherein the flow extends from the intake side of the cylinder head to the exhaust side and the coolant outlet is adjacent the exhaust passage.

5. A cooling arrangement as set forth in claim 4 wherein there are plural intake ports and plural exhaust ports.

6. A cooling arrangement as set forth in claim 5 wherein there are more intake ports than exhaust ports.

7. A cooling arrangement as set forth in claim 6 wherein at least the intake passages are siamesed.

8. A cooling arrangement as set forth in claim 1 wherein the flow directing means comprises a pair of members extending vertically through the cooling jacket from the cylinder head lower surface to the cylinder head upper surface.

9. A cooling arrangement as set forth in claim 8 wherein the projections are offset from the center of the cylinder toward the side from which the flow exits.

10. A cooling arrangement as set forth in claim 9 wherein the flow extends from the intake side of the cylinder head to the exhaust side and the coolant outlet is adjacent the exhaust passage.

11. A cooling arrangement as set forth in claim 10 wherein there are plural intake ports and plural exhaust ports.

12. A cooling arrangement as set forth in claim 11 wherein there are more intake ports than exhaust ports.

13. A cooling arrangement as set forth in claim 12 wherein at least the intake passages are siamesed.

14. A cooling arrangement as set forth in claim 1 wherein the flow directing means is spaced approximately equal distances from the intake and exhaust passages so that the flow area through the cylinder head from the inlet of the coolant to the outlet of the coolant is substantially equal.

15. A cooling arrangement as set forth in claim 1 wherein there are plural intake ports and plural exhaust ports.

16. A cooling arrangement as set forth in claim 15 wherein there are more intake ports than exhaust ports.

17. A cooling arrangement as set forth in claim 16 wherein at least the intake passages are siamesed.

* * * * *

UNITED STATES PATENT AND TRADEMARK OFFICE

CERTIFICATE OF CORRECTION

PATENT NO. : 5,094,193

DATED : March 10, 1992

INVENTOR(S) : Masaaki Yoshikawa

It is certified that error appears in the above-identified patent and that said Letters Patent is hereby corrected as shown below:

On the Title Page under "Assignee", "Kaishas" should be --Kaisha--.

Column 5, line 42, Claim 1, after "head" insert --there being plural intake ports and plural exhaust ports with more intake ports than exhaust ports and at least the intake passages are siamesed,--.

Signed and Sealed this

Thirty-first Day of August, 1993

*Attest:*

*Attesting Officer*

BRUCE LEHMAN

*Commissioner of Patents and Trademarks*